US008692476B2

(12) United States Patent
Gao

(10) Patent No.: US 8,692,476 B2
(45) Date of Patent: Apr. 8, 2014

(54) BOOST CIRCUIT FOR LED BACKLIGHT DRIVER CIRCUIT

(75) Inventor: Xin-Ming Gao, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 393 days.

(21) Appl. No.: 13/203,979

(22) PCT Filed: Jun. 23, 2011

(86) PCT No.: PCT/CN2011/076174

§ 371 (c)(1),
(2), (4) Date: Aug. 30, 2011

(87) PCT Pub. No.: WO2012/171230

PCT Pub. Date: Dec. 20, 2012

(65) Prior Publication Data

US 2012/0319611 A1 Dec. 20, 2012

(30) Foreign Application Priority Data

Jun. 16, 2011 (CN) ..... 2011 2 0203986

(51) Int. Cl.
*H05B 41/16* (2006.01)

(52) U.S. Cl.
USPC ..... 315/247; 315/209 R; 315/246; 315/291

(58) Field of Classification Search
USPC ..... 315/209 R, 246, 247, 291
See application file for complete search history.

(56) References Cited

U.S. PATENT DOCUMENTS

| | | | | |
|---|---|---|---|---|
| 6,529,182 | B1 | 3/2003 | Burton | |
| 7,408,308 | B2 * | 8/2008 | Sawada et al. | 315/291 |
| 7,733,030 | B2 * | 6/2010 | Brokaw et al. | 315/209 R |
| 8,421,364 | B2 * | 4/2013 | Archibald et al. | 315/209 R |
| 2002/0097008 | A1 * | 7/2002 | Krummel | 315/291 |
| 2009/0079355 | A1 * | 3/2009 | Zhou et al. | 315/246 |

FOREIGN PATENT DOCUMENTS

| | | | |
|---|---|---|---|
| CN | 2445351 | Y | 8/2001 |
| CN | 101820223 | A | 9/2010 |
| GB | 2355816 | A | 5/2001 |
| KR | 10-2006-0089289 | A | 8/2006 |

* cited by examiner

*Primary Examiner* — Thuy Vinh Tran
(74) *Attorney, Agent, or Firm* — Mark M. Friedman

(57) ABSTRACT

A boost circuit for an LED (Light Emitting Diode) backlight driver circuit is disclosed; said boost circuit includes a PWM (Pulse Width Modulation) chip, a second capacitor, and a signal processing circuit. A VCC pin of the PWM chip is coupled to the input node, and the PWM chip is utilized to generate a PWM signal. One end of the second capacitor is coupled to an output pin of the PWM chip, and the second capacitor is utilized to filter out a direct current component of the PWM signal. One terminal of the signal processing circuit is coupled to the second capacitor, and another terminal thereof is coupled to a gate of the switch. The signal processing circuit is used to adjust the filtered PWM signal for generating corresponding high levels and low levels. A regulator is omitted in the present invention, therefore reducing costs.

15 Claims, 4 Drawing Sheets

200

220

BOOST CIRCUIT FOR LED BACKLIGHT DRIVER CIRCUIT

FIELD OF THE INVENTION

The present invention relates to a boost circuit, and especially to a boost circuit for an LED (Light Emitting Diode) backlight driver circuit.

BACKGROUND OF THE INVENTION

An LED has advantages of long life, high light efficiency, and energy saving, so the LED is gradually utilized as a backlight source of an LCD. The following description refers to a conventional driving circuit of an LED backlight. Referring to FIG. 1, FIG. 1 is a schematic drawing illustrating a conventional driving circuit of the LED backlight. LEDs that are driven are only shown as "LOAD" in FIG. 1, and the load is the LEDs connected with a series connection or a plurality of serial LEDs connected with a parallel connection.

A first capacitor C1, an inductor L, a first switch Q1, a diode D, a first resistor R1, and a second capacitor C2, consist of external power components of a boost circuit. An output pin (pin 6) of a PWM (Pulse Width Modulation) chip (UC3843) is coupled to a gate of the first switch Q1. The PWM chip (UC3843) controls said external power components through the output pin, so that the boost circuit can supply the load with enough output voltage.

The first switch Q1, the second switch Q2, and third switch Q3, are MOSFETs, which can withstand voltage between the gate-source (GS) usually being positive and negative 20V. In order to prevent the switches to withstand too high of a voltage, a regulator 101 has to be disposed in the conventional boost circuit for supplying the first switch Q1 with a driving voltage and supplying the PWM chip (UC3843) with a VCC. The currently known regulators can be categorized into linear regulators and switching regulators. The linear regulators have a shortcoming of high power consumption as well as a requirement of a larger cooling area. The switching regulators, however, have higher power conversion efficiency than the linear regulators, but the switching regulators are expensive.

SUMMARY OF THE INVENTION

Accordingly, an objective of the present invention is to provide a boost circuit for an LED backlight driver circuit, and the above-mentioned regulator thereof can be omitted and thus solves the above-mentioned shortcoming.

To achieve the foregoing objective, according to an aspect of the present invention, a boost circuit for an LED backlight driver circuit is provided. The boost circuit has an input node, an output node, and a plurality of external power components having an inductor, a first diode, a switch, and a first capacitor. Furthermore, the boost circuit comprises: a PWM (Pulse Width Modulation) chip, a second capacitor, and a signal processing circuit.

A VCC pin of the PWM chip is coupled to the input node, and the PWM chip is utilized to generate a PWM signal. One end of the second capacitor is coupled to an output pin of the PWM chip, and the second capacitor is utilized to filter out a direct current component of the PWM signal. One terminal of the signal processing circuit is coupled to the second capacitor, and another terminal thereof is coupled to a gate of the switch. The signal processing circuit is used to adjust the filtered PWM signal for generating corresponding high levels and low levels.

Preferably, the signal processing circuit includes a second diode, a first resistor, a triode, and a second resistor. The second diode is connected in parallel to the first resistor and the triode, and an anode of the second diode is coupled to the second capacitor, also a cathode thereof is coupled to the second resistor and a collector of the triode. A base of the triode is coupled to the first resistor, and an emitter thereof is grounded. The second resistor is coupled to the gate of the switch.

Preferably, the triode is a PNP triode.

Preferably the PWM chip is one of UC384X series, such as a UC3843.

Preferably, a high level of the PWM signal is an input voltage of the input node, and a low level thereof is zero with a duty cycle D. Moreover, the direct current component is the input voltage multiplied by D. More specifically, the high level of the filtered PWM signal is the input voltage minus the direct current component, and the low level of the filtered PWM signal is the negative direct current component.

Compared with the prior art, the boost circuit of the present invention is directly coupled to the input voltage through the PWM chip, and the direct current component within the PWM signal is filtered out by the second capacitor, and then the filtered PWM signal is simply modified to directly control on and off of the switch. The above-mentioned regulator is omitted in the present invention, and thus reduces costs.

It is to be understood that both the foregoing general description and the following detailed description of the present invention are exemplary and explanatory and are intended to provide further explanation of the invention as claimed:

DETAILED DESCRIPTION OF THE PREFERRED EMBODIMENTS

Figure 1:
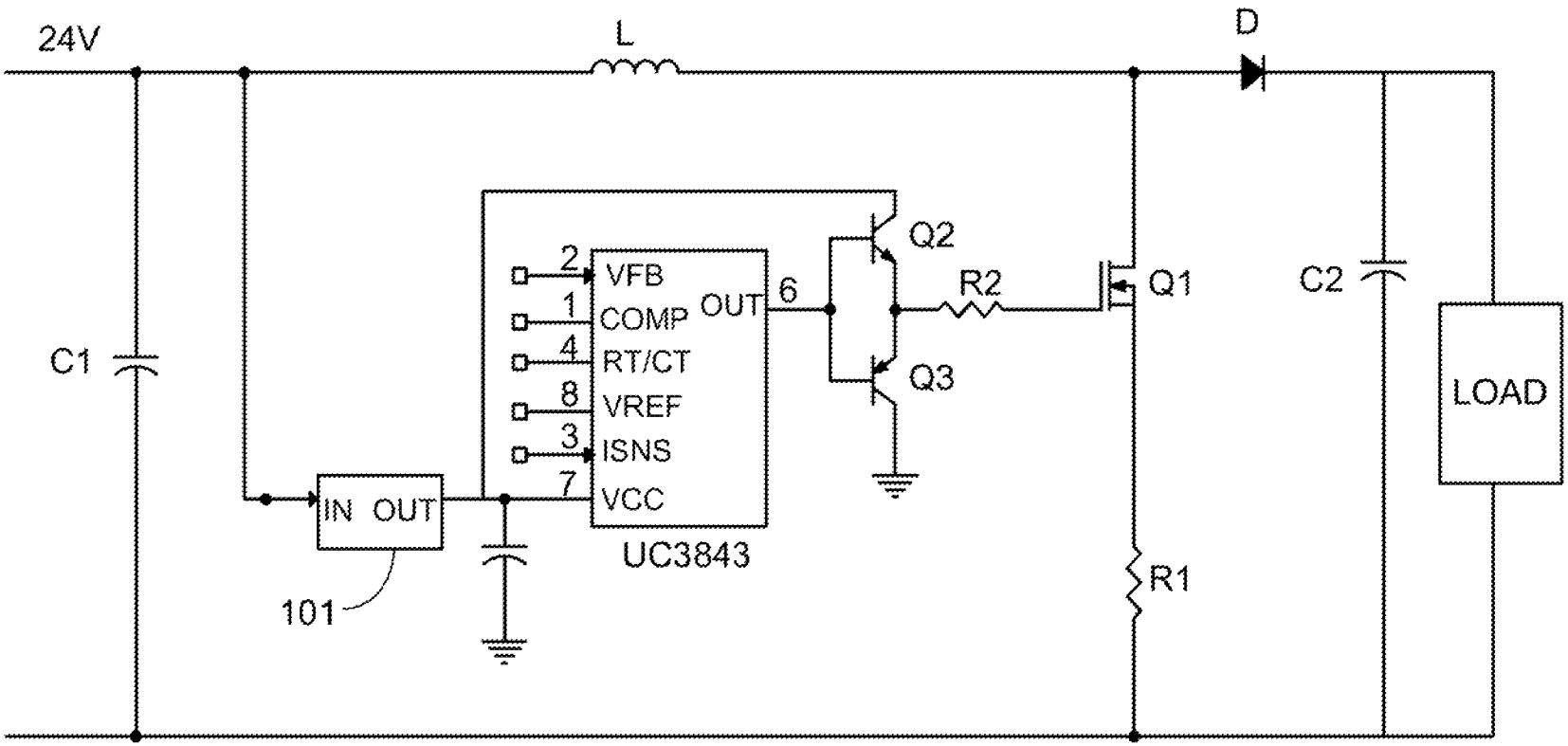
FIG. 1(Prior art)
FIG. 1 is a schematic drawing illustrating a conventional driving circuit of an LED backlight.
Figure 2:
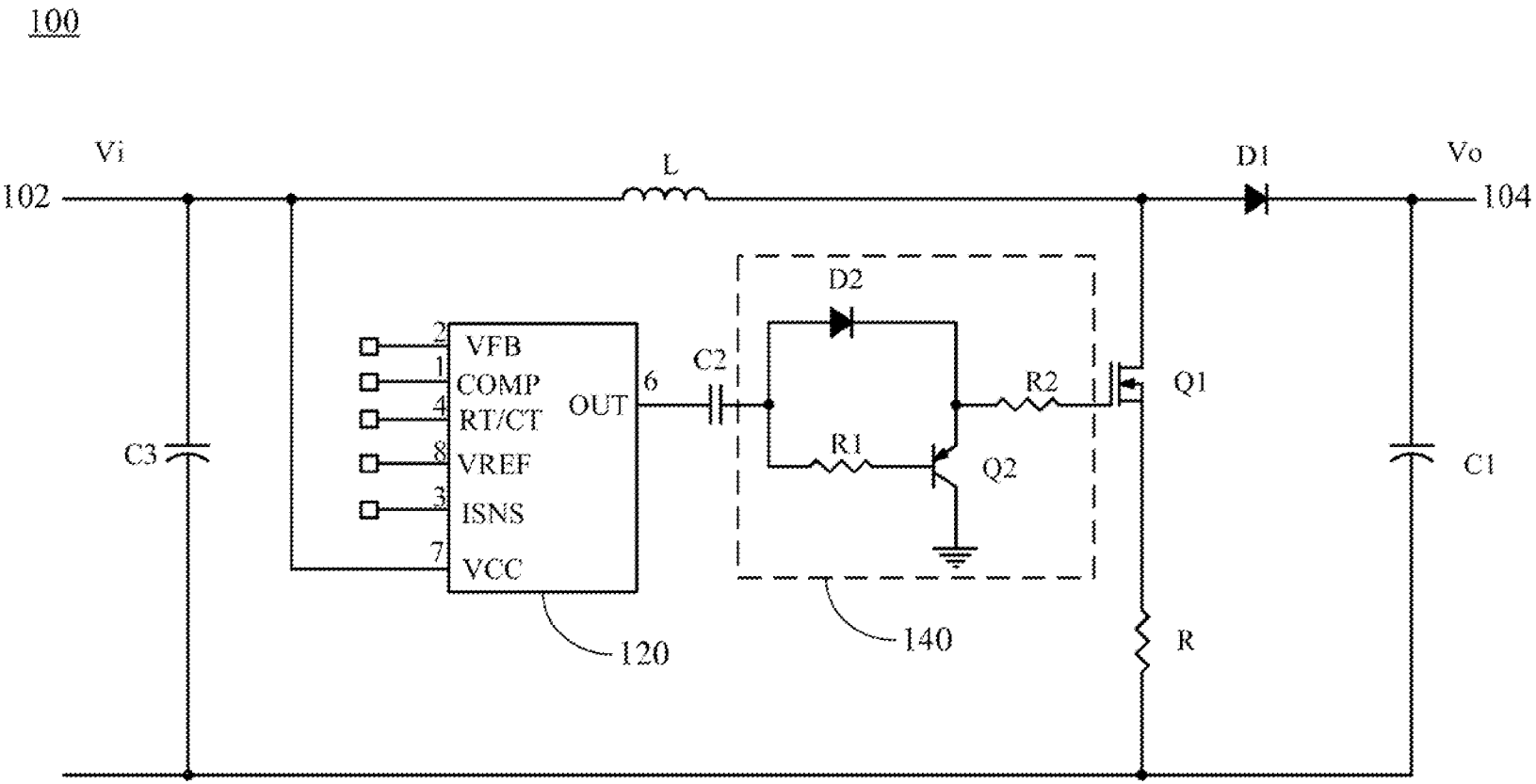
FIG. 2 is a schematic circuit illustrating a boost circuit for an LED backlight driver circuit according to one preferred embodiment of the present invention.

Referring to FIG. 2, FIG. 2 is a schematic circuit illustrating a boost circuit for an LED backlight driver circuit according to one preferred embodiment of the present invention. The boost circuit 100 has an input node 102, an output node 104, and a plurality of external power components, wherein the input node 102 has an input voltage Vi, and the output node 104 has an output voltage Vo. The external power components have an inductor L, a first diode D1, a switch Q1, a resistor R, a first capacitor C1, and a third capacitor C3. Said external power components are well known by the person skilled in the art, so no further details will be provided herein.

The boost circuit 100 according to the preferred embodiment of the present invention further includes a PWM chip 120, a second capacitor C2, and a signal processing circuit 140. In the preferred embodiment, the PWM chip is one of UC384X series, such as a UC3843. However, the present invention is not limited to be implemented in the above-mentioned chips. A UC3843 has 7 pins: pin 1 is COMP, pin 2 is VFB, pin 3 is ISNS, pin 4 is RT/CT, pin 5 (not shown) is ground, pin 6 is an output pin OUT, and pin 7 is a power supply pin VCC. The details of the pins can be referred to in the data sheet of the UC3843, hence no further details are provided herein. Furthermore, in order to explain more clearly, the connections of only the OUT and VCC pins are depicted. The power supply pin VCC of the PWM chip 120 is coupled to the input node 102, and the PWM chip 120 is utilized to generate a PWM signal.

Figure 3:
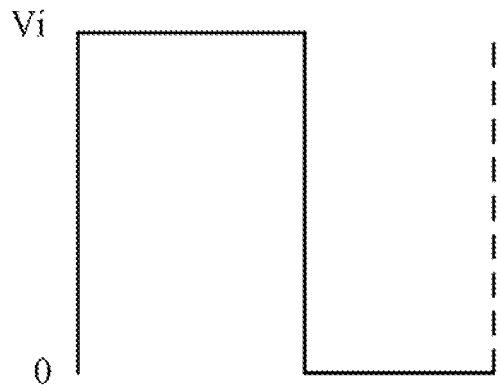
FIG. 3 is a schematic drawing illustrating a waveform of the PWM signal generated by the PWM chip according to the preferred embodiment.

Referring to FIG. 3, FIG. 3 is a schematic drawing illustrating a waveform of the PWM signal generated by the PWM chip according to the preferred embodiment. The PWM signal 200 is a square wave with a period T. A high level of the PWM signal 200 is the input voltage Vi of the input node 102, and a low level thereof is zero with a duty cycle D. Moreover, the duration of the high level is Ton, and the duration of the low level is Toff. Furthermore, the ratio of Ton to the period T is the duty cycle D, i.e. D=Ton/T.

Figure 4:
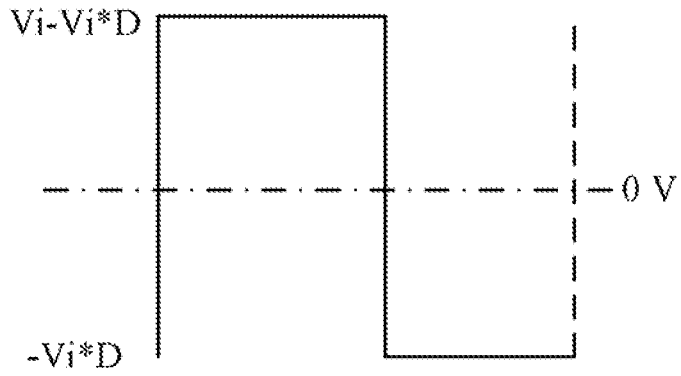
FIG. 4 is a schematic drawing illustrating a waveform of the PWM signal after filtering out a direct current component.

Referring to FIG. 2 again, in conjunction with FIG. 4, FIG. 4 is a schematic drawing illustrating a waveform of the PWM signal after filtering out a direct current component. One end of the second capacitor C2 is coupled to an output pin OUT of the PWM chip 120, and the second capacitor C2 is utilized to filter out a direct current component of the PWM signal 200. In the preferred embodiment, the direct current component is the input voltage Vi multiplied by D, i.e. Vi*D. More specifically, the high level of the filtered PWM signal 220 is the input voltage Vi minus the direct current component Vi*D, and the low level of the filtered PWM signal is the negative direct current component −Vi*D.

Referring to FIG. 2 again, one terminal of the signal processing circuit 140 (shown as dashed lines) is coupled to the second capacitor C2, and another terminal thereof is coupled to the gate of the switch Q1. The signal processing circuit 140 is utilized to adjust the filtered PWM signal 220 thereby generating corresponding high levels and low levels to the switch Q1, so that the switch Q1 is "on" at the high level and "off" at the low level.

In the preferred embodiment, the signal processing circuit 140 comprises a second diode D2, a first resistor R1, a triode, Q2 and a second resistor R2. The second diode D2 is connected in parallel to the first resistor R1 and the triode Q2, and an anode of the second diode D2 is coupled to the second capacitor C2, also a cathode thereof is coupled to the second resistor R2 and a collector of the triode Q2. A base of the triode Q2 is coupled to the first resistor R1, and an emitter thereof is grounded. The second resistor R2 is coupled to the gate of the switch Q1. More specifically, the triode is a PNP triode.

Figure 5:
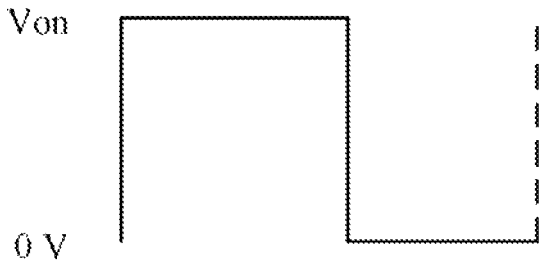
FIG. 5 is a schematic drawing illustrating a waveform of the corresponding high levels and low levels modified by the signal processing circuit.

Referring to FIGS. 2 and 5, FIG. 5 is a schematic drawing illustrating a waveform of the corresponding high levels and low levels modified by the signal processing circuit. When the filtered PWM signal 220 is at a high level, the second diode D2 is conducting, and the PNP triode Q2 is at an off-state (non-conducting). Therefore, the corresponding high level that Vi−Vi*D passes through the second resistor R2 is Von, which is less than Vi−Vi*D. When the filtered PWM signal 220 is at a low level, the second diode D2 is cut-off (non-conducting), and the base to the emitter of the PNP triode Q2 is conducting. Therefore, the gate of the switch Q1 is grounded, that is, the corresponding low level is 0. Accordingly, the low withstand-voltage switch Q1 (MOSFET) can be protected according to the corresponding high level Von and the corresponding low level 0. However, the signal processing circuit of the present invention is not limited to be implemented in the above-mentioned circuit, and it can also be implemented in other circuits.

Reference to the aforementioned principle of operation, the boost circuit 100 of the present invention is directly coupled to the input voltage Vi through the PWM chip 120, and the direct current component within the PWM signal is filtered out by the second capacitor C2, and then the filtered PWM signal is simply modified to directly control on and off of the switch. Therefore, the regulator that is required in the prior art can be omitted in the present invention, and cost is reduced.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A boost circuit for an LED (Light Emitting Diode) backlight driver circuit, the boost circuit having an input node, an output node, and a plurality of external power components having an inductor, a first diode, a switch, and a first capacitor, wherein the boost circuit further comprises:

a PWM (Pulse Width Modulation) chip for generating a PWM signal, a VCC pin of the PWM chip coupled to the input node;

a second capacitor for filtering out a direct current component of the PWM signal, one end of the second capacitor coupled to an output pin of the PWM chip; and a signal processing circuit having one terminal coupled to the second capacitor, another terminal thereof coupled to a gate of the switch, and the signal processing circuit is used to adjust the filtered PWM signal for generating corresponding high levels and low levels to the gate of the switch, for directly controlling on and off of the switch.

2. The boost circuit according to claim 1, wherein the signal processing circuit comprises a second diode, a first resistor, a triode, and a second resistor, wherein the second diode is connected in parallel to the first resistor and the triode, and an anode of the second diode is coupled to the second capacitor, also a cathode thereof is coupled to the second resistor and a collector of the triode, wherein a base of the triode is coupled to the first resistor, and an emitter thereof is grounded, wherein the second resistor is coupled to the gate of the switch.

3. The boost circuit according to claim 1, wherein the PWM chip is one of UC384X series.

4. The boost circuit according to claim 3, wherein the PWM chip is a UC3843.

5. The boost circuit according to claim 1, wherein a high level of the PWM signal is an input voltage of the input node, and a low level is zero with a duty cycle D.

6. The boost circuit according to claim 5, wherein the direct current component is the input voltage multiplied by the duty cycle D.

7. The boost circuit according to claim 6, wherein the high level of the filtered PWM signal is the input voltage minus the direct current component, and the low level of the filtered PWM signal is the negative direct current component.

8. A boost circuit for an LED (Light Emitting Diode) backlight driver circuit, the boost circuit having an input node, an output node, and a plurality of external power components, wherein the external power components comprise an inductor, a first diode, a switch, and a first capacitor, wherein the boost circuit further comprises:

a PWM (Pulse Width Modulation) chip for generating a PWM signal, a VCC pin of the PWM chip coupled to the input node;

a second capacitor for filtering out a direct current component of the PWM signal, one end of the second capacitor coupled to an output pin of the PWM chip; and a signal processing circuit having one terminal of the signal processing circuit coupled to the second capacitor, another terminal thereof coupled to a gate of the switch, and the signal processing circuit is used to adjust the filtered PWM signal for generating corresponding high levels and low levels.

9. The boost circuit according to claim 8, wherein the signal processing circuit comprises a second diode, a first resistor, a triode, and a second resistor, wherein the second diode is connected in parallel to the first resistor and the triode, and an anode of the second diode is coupled to the second capacitor, also a cathode thereof is coupled to the second resistor and a collector of the triode, wherein a base of the triode is coupled to the first resistor, and an emitter thereof is grounded, wherein the second resistor is coupled to the gate of the switch.

10. The boost circuit according to claim 9, wherein the triode is a PNP triode.

11. The boost circuit according to claim 8, wherein the PWM chip is one of UC384X series.

12. The boost circuit according to claim 8, wherein the PWM chip is a UC3843.

13. The boost circuit according to claim 8, wherein a high level of the PWM signal is an input voltage of the input node, and a low level is zero with a duty cycle D.

14. The boost circuit according to claim 13, wherein the direct current component is the input voltage multiplied by the duty cycle D.

15. The boost circuit according to claim 14, wherein the high level of the filtered PWM signal is the input voltage minus the direct current component, and the low level of the filtered PWM signal is the negative direct current component.

* * * * *